US006260449B1

(12) United States Patent
I-He

(10) Patent No.: US 6,260,449 B1
(45) Date of Patent: Jul. 17, 2001

(54) RATCHET TOOL

(76) Inventor: Liao I-He, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/490,123

(22) Filed: Jan. 24, 2000

(51) Int. Cl.[7] ..... B25B 13/46
(52) U.S. Cl. ..... 81/63.2; 81/63; 81/63.1
(58) Field of Search ..... 81/63.2, 63.1, 81/63

(56) References Cited

U.S. PATENT DOCUMENTS 5,499,560 * 3/1996 Aeschilman .
5,957,009 * 9/1999 McCann .
6,065,374 * 5/2000 Taggart .
6,070,502 * 6/2000 Chang .

* cited by examiner

*Primary Examiner*—Timothy V. Eley
*Assistant Examiner*—Willie Berry, Jr.
(74) *Attorney, Agent, or Firm*—Charles E. Baxley

(57) ABSTRACT

A ratchet tool includes a head and a toothed member is rotatably received in an interior of the head. An output shaft extends from the toothed member. A frame having two plates is pivotably received in the interior of the head and one of the two plates has a slot defined therethrough. A pawl member received in between the two plates of the frame and a toothed curve surface is defined in a first end of the pawl member so as to engage with the toothed member, and a rib extends from a second end of the pawl member. A spring and a ball are received in the frame and the ball is urged against the second end of the pawl member. A boss extends from the pawl member and is movably received in the slot so as to allow the pawl member to disengage from the toothed member when the output shaft is remained still while the tool is rotated.

4 Claims, 5 Drawing Sheets

RATCHET TOOL

FIELD OF THE INVENTION

The present invention relates to a ratchet tool, and more particularly, to an improved ratchet tool that has a pawl member with a curved toothed surface which is engaged with the toothed member in the head of the ratchet tool so as to output a large torque.

BACKGROUND OF THE INVENTION

A conventional ratchet tool is shown in FIG. 1 and generally includes a head 1 with a toothed member 2 rotatably received in an interior 12 of the head 1. A recess 11 is defined in an inside of the interior of the head 1 and a spring 12 and a ball 12 are received in the recess 11. A pawl member 3 is pivotally received in the interior of the head 1 and has two distal ends. Each distal end has two teeth 30 so that either one of the two distal ends is engaged with the toothed member 2 to decide the effective direction of the output shaft. The pawl member 3 has a lever 35 connected thereto so that the user may switch the lever 35 to rotate the pawl member 3. Nevertheless, when outputting a torque, there are only two teeth 30 on the distal end of the pawl member 3 engaged with the toothed member 2 so that it is difficult to output a large torque because the engagement force between the two teeth 30 and the toothed member 2 is not sufficient. In other words, the more the teeth of the pawl member are engaged with the toothed member, the larger the torque that the tool can apply.

The present invention intends to provide a ratchet tool that can applies a large torque. A pawl member has a toothed curved surface and a lot of teeth are defined in the curved surface so that are engaged with the toothed member so as to apply a large torque.

SUMMARY OF THE INVENTION

In accordance with one aspect of the present invention, there is provided a ratchet tool comprising a head having a toothed member rotatably received therein and an output shaft extends from the toothed member. A frame is pivotably received in the head and has two plates extending therefrom, wherein one of the two plates has a slot defined therethrough and a recess defined in the frame for receiving a spring and a ball therein. A pawl member has a toothed curve surface in a first end of the pawl member and a rib extends from a second end of the pawl member so that the ball is urged against the second end of the pawl member. The toothed curve 4, surface is engaged with the toothed member. A boss extends from the pawl member and is movably received in the slot.

The object of the present invention is to provide a ratchet tool wherein the pawl member has a toothed curved surface which includes a plurality of teeth which are engaged with the toothed member so that the ratchet tool bears a large torque.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
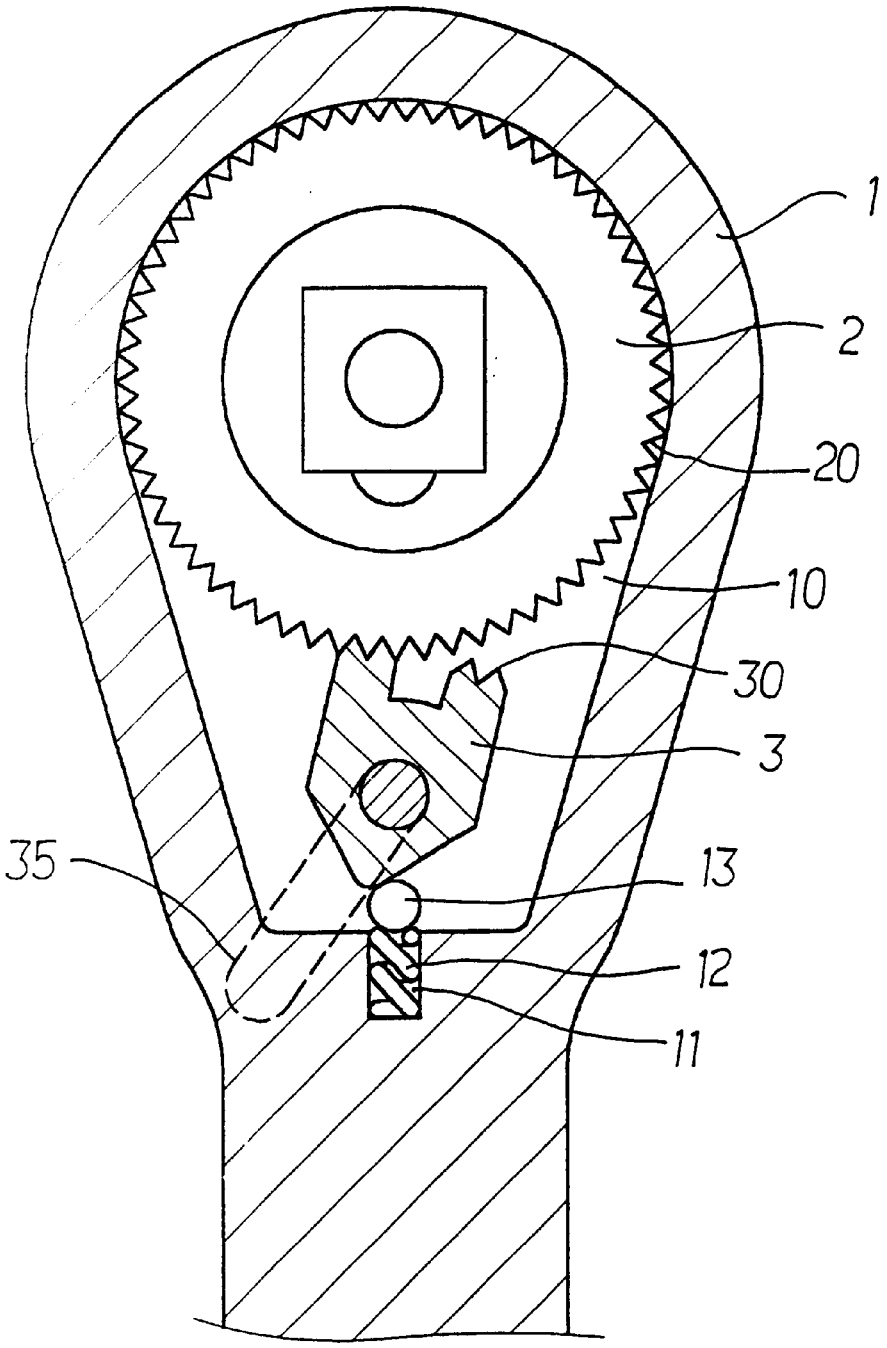
FIG. 1 PRIOR ART
FIG. 1 is a cross sectional view to show a conventional view of a conventional ratchet tool.
Figure 2:
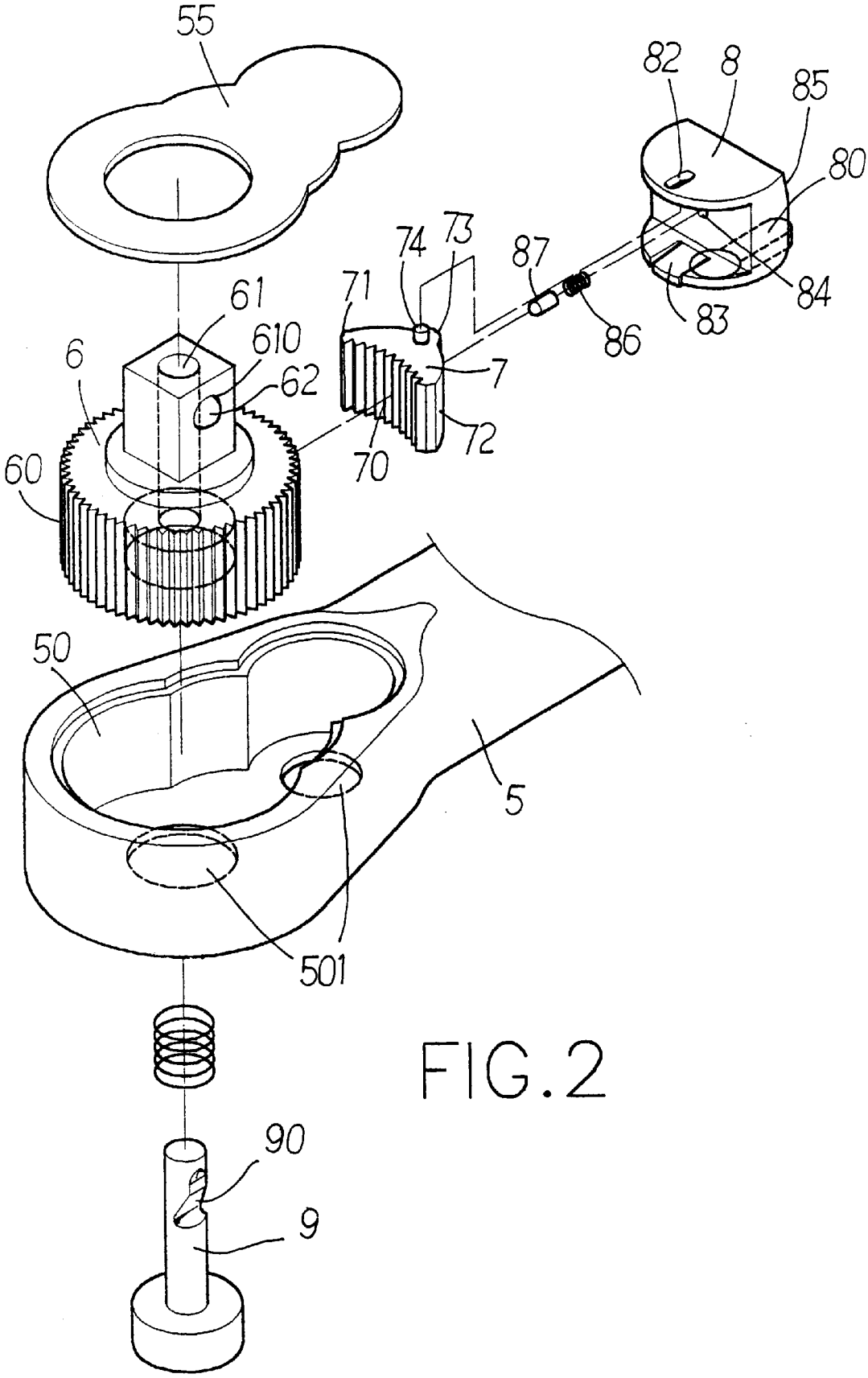
FIG. 2 is an exploded view to show a ratchet tool in accordance with the present invention.
Figure 3:
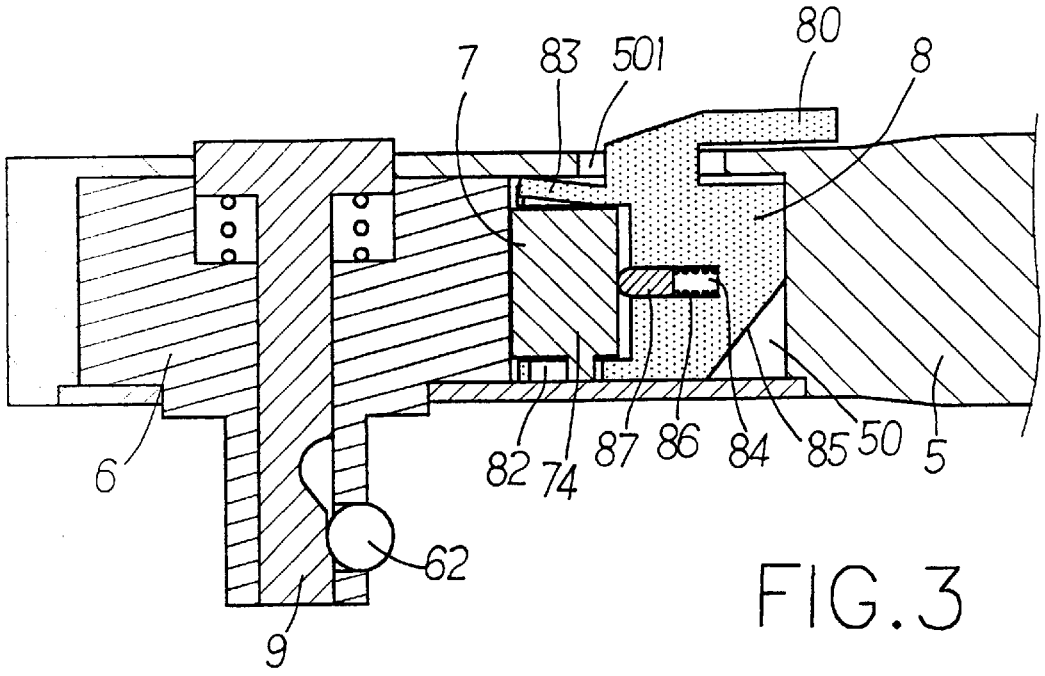
FIG. 3 shows a side cross sectional view to show the ratchet tool of the present invention, wherein the ball in the frame is urged against the rib on the pawl member.
Figure 4:
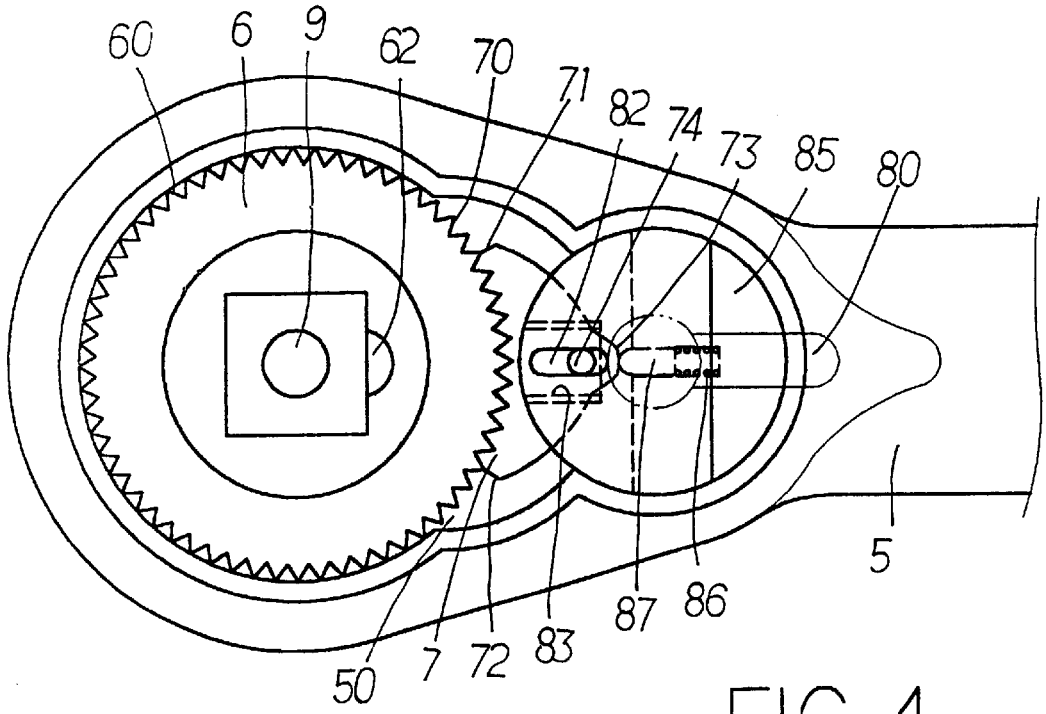
FIG. 4 is a top view to show the arrangement of the ratchet tool as shown in FIG. 3.

Referring to FIGS. 2 to 4, the ratchet tool in accordance with the present invention comprises a head having an open top and a bottom through which two holes 501 are defined. A cover 55 is engaged with the open top of the head and has a hole defined therethrough. A handle 5 extends from the head and a toothed member 6 is rotatably received in an interior 50 of the head. An output shaft extends from the toothed member and the hole in the cover 55. A passage 61 is defined through the output shaft and the toothed member 6. The output shaft has a side hole 610 which communicates with the passage 61 and a ball 62 is engaged with the side hole 610 so that a socket (not shown) can be securely engaged with the output shaft by the ball 62. A push rod 9 has an enlarged head is movably received in the passage 61 and a spring is biased between the enlarged head and a recess defined in the toothed member. The enlarged head of the push rod 9 can be accessed from one of the tow holes 501 in the bottom of the head. The push rod 9 has a notch 90 defined in an outside thereof so that when the push rod 9 is pushed, the ball 62 in the side hole 610 is received in the notch 90 so as to easily disengage the socket from the output shaft.

A frame 8 is pivotably received in the interior 50 of the head and two plates extend from a first end of the frame 8. A concavity 85 is defined in a second end of the frame 8. One of the two plates has a slot 82 defined therethrough and the other plate of the frame 8 has a convex portion 83 which contacts the cover 55. A recess 84 is defined in the frame 8 and located between the two plates. A spring 86 and a ball 87 are respectively received in the recess 84. A lever 80 is connected to the frame 8 and extends from the other hole 501 in the bottom of the head. The concavity 85 allows assemblers to install the frame in the head without interference between the lever 80 and the hole 501 of in the bottom of the bead.

A pawl member 7 having a toothed curve surface 70 defined in a first end of the pawl member 7 and a rib 73 extends from a second end of the pawl member 7. The ball 87 is urged against the second end of the pawl member 7. The toothed curve surface 70 includes a lots of teeth which are engaged with the teeth 60 of the toothed member 6. A boss 74 extends from the pawl member 7 and is movably received in the slot 82. The pawl member 7 has two curved sides 71, 72 which are matched with an inside defining the interior 50 of the head.

Figure 5:
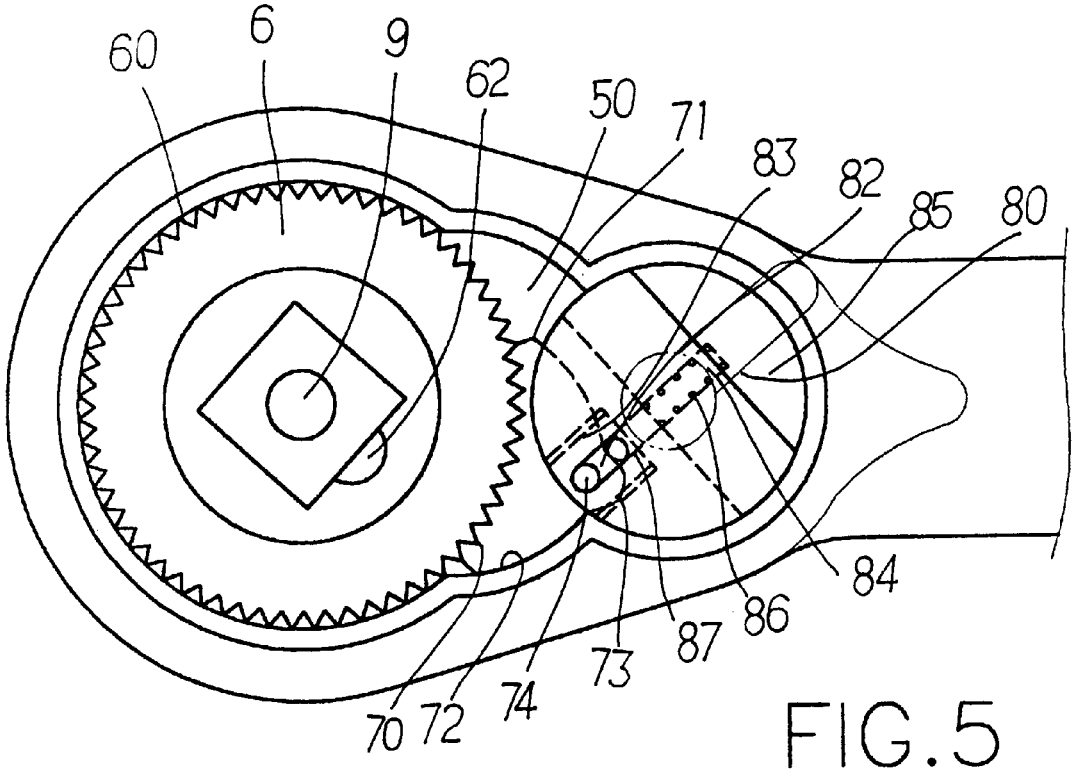
FIG. 5 is an illustrative view to show when the frame is pivoted counter clockwise and the pawl member will not disengage from the toothed member when rotating the handle of the tool clockwise.
Figure 7:
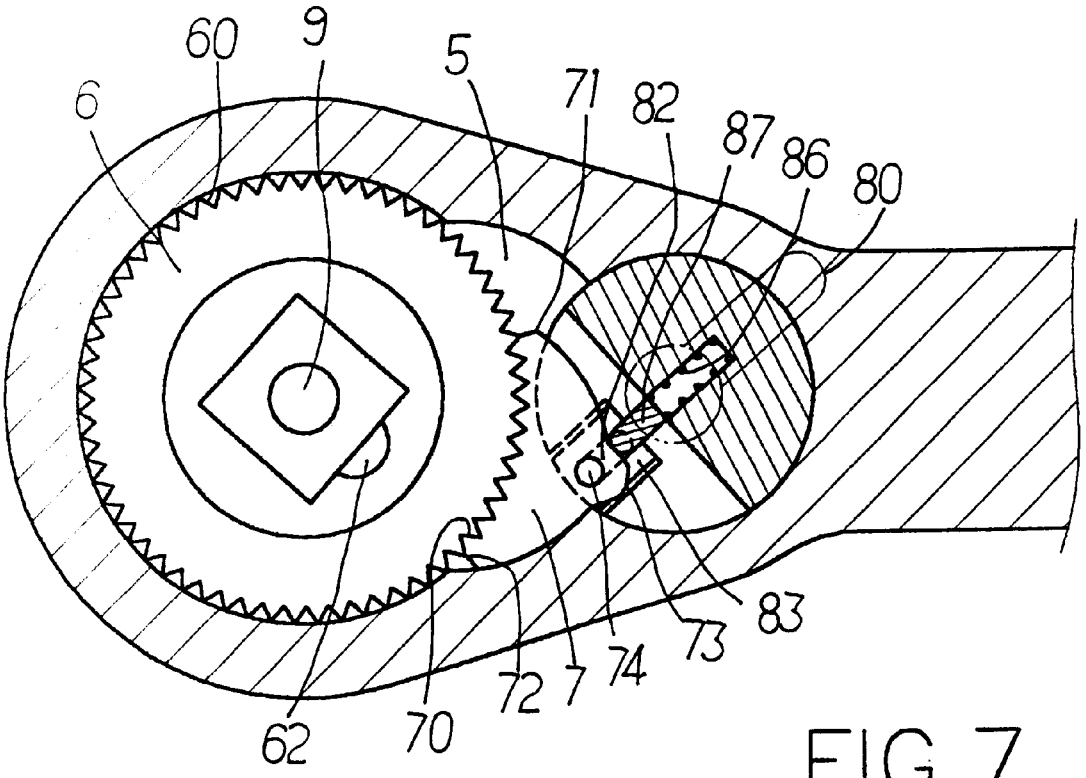
FIG. 7 is a cross sectional view to show the ball in the frame contacting a side of the rib of the pawl member which is positioned as shown in FIG. 5.

Referring to FIGS. 5 and 7, when the user shifts the lever 80 counter clockwise, the ball 87 pushes the pawl member 7 to let one curved side 72 of the pawl member 7 engaged with the inside of the head as shown. At this position, when rotating the handle 5 counter clockwise, if the output shaft is engaged with an object, the pawl member 7 will be pushed by the inside of the head to ward the toothed member 6 so as to rotate the toothed member to output a torque. One the contrary, if rotating the handle 5 clockwise, the stationary toothed member 6 will push the pawl member 7 toward the frame 8 to let the boss 74 move within the slot 82 so that no torque is applied to the object.

Figure 6:
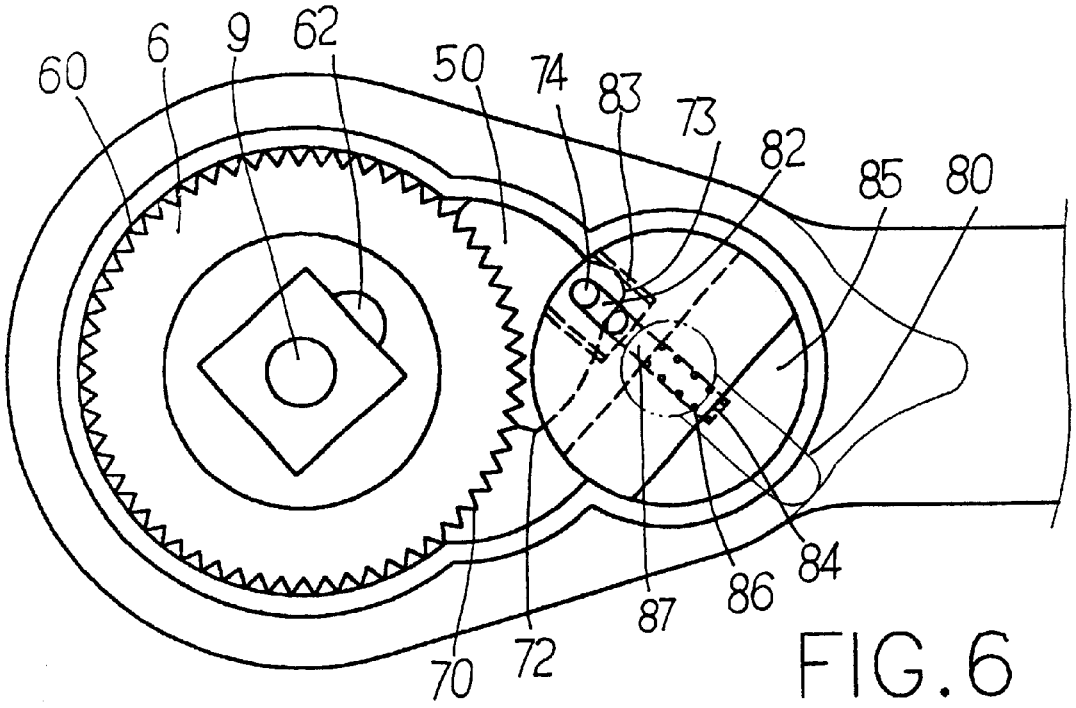
FIG. 6 is an illustrative view to show when the frame is pivoted clockwise and the pawl member will be disengaged from the toothed member when rotating the handle of the tool clockwise.
Figure 8:
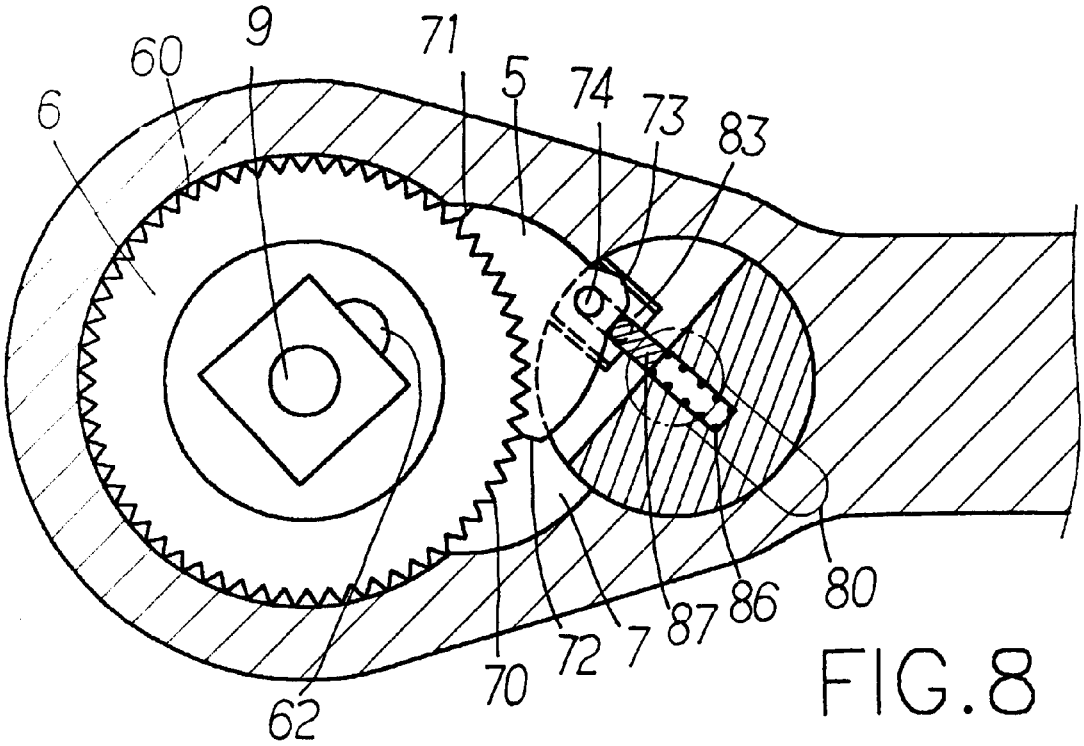
FIG. 8 is a cross sectional view to show the ball in the frame contacting the other side of the rib of the pawl member which is positioned as shown in FIG. 6.

Referring to FIGS. 6 and 8, when the user shifts the lever 80 clockwise, the ball 87 pushes the pawl member 7 to let one curved side 71 of the pawl member 7 engaged with the inside of the head as shown. When rotating the handle 5 clockwise, if the output shaft is engaged with an object, the pawl member 7 will be pushed by the inside of the head to ward the toothed member 6 so as to rotate the toothed member to output a torque. If rotating the handle 5 counter clockwise, the stationary toothed member 6 will push the pawl member 7 toward the frame 8 to let the boss 74 move within the slot 82 so that no torque is applied to the object.

Because there are a lots of teeth in the toothed curved surface 70 of the pawl member 7 so that there are sufficient engagement force between the toothed member 6 and the pawl member 7 so that the ratchet tool can output a large torque.

While we have shown and described various embodiments in accordance with the present invention, it should be clear to those skilled in the art that further embodiments may be made without departing from the scope and spirit of the present invention.

What is claimed is:

1. A ratchet tool comprising:

a head having an interior and a handle extending from the head, a toothed member rotatably received in the interior of the head, an output shaft extending from said toothed member, a passage defined through said output shaft and said toothed member, a push rod movably received in said passage, said output shaft having a side hole which communicates with said passage and a ball engaged with said side hole, said push rod having a notch defined in an outside thereof so that when said push rod is pushed, said ball in said side hole is received in said notch;

a frame pivotably received in said interior of said head and two plates extending from a first end of said frame, one of said two plates having a slot defined therethrough, a recess defined in said frame and located between said two plates, a spring and a ball received in said recess, and a pawl member having a toothed curve surface defined in a first end of said pawl member and a rib extending from a second end of said pawl member, said ball urged against said second end of said pawl member, said toothed curve surface engaged with said toothed member, a boss extending from said pawl member and movably received in said slot.

2. The ratchet tool as claimed in claim 1 further comprising a cover engaged with said head and the other plate of said frame having a convex portion which contacts said cover.

3. The ratchet tool as claimed in claim 1 further comprising a lever connected to said frame.

4. The ratchet tool as claimed in claim 1, wherein said frame has a concavity defined in a second end thereof.

* * * * *